United States Patent [19]

Wendt

[11] Patent Number: 4,894,503

[45] Date of Patent: Jan. 16, 1990

[54] PACKAGES MATERIALS FOR SHIELDED FOOD CONTAINERS USED IN MICROWAVE OVENS

[75] Inventor: Dan J. Wendt, Lino Lakes, Minn.

[73] Assignee: The Pillsbury Company, Minneapolis, Minn.

[21] Appl. No.: 113,171

[22] Filed: Oct. 23, 1987

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F, 219/10.55 R, 10.55 M; 426/107, 243, 241, 234; 99/DIG. 14

[56] References Cited

U.S. PATENT DOCUMENTS

| | | | |
|---|---|---|---|
| 3,219,460 | 11/1965 | Brown | 99/192 |
| 3,271,169 | 9/1966 | Baker et al. | 99/221 |
| 3,271,552 | 9/1966 | Krajewski | 219/10.55 |
| 3,547,661 | 12/1970 | Stevenson | 99/171 |
| 3,615,713 | 10/1971 | Stevenson | 99/171 H |
| 3,941,967 | 3/1976 | Sumi et al. | 219/10.55 E |
| 3,946,188 | 3/1976 | Derby | 219/10.55 E |
| 4,144,438 | 3/1979 | Gelman et al. | 219/10.55 E |
| 4,183,435 | 1/1980 | Thompson et al. | 206/557 |
| 4,190,757 | 2/1980 | Turpin et al. | 219/10.55 E |
| 4,196,331 | 4/1980 | Leveckis et al. | 219/10.55 E |
| 4,204,105 | 5/1980 | Leveckis et al. | 219/10.55 E |
| 4,210,674 | 7/1980 | Mitchell | 426/107 |
| 4,228,334 | 10/1980 | Clark et al. | 219/10.55 E |
| 4,230,924 | 10/1980 | Brastad et al. | 219/10.55 E |
| 4,233,325 | 11/1980 | Slangan et al. | 426/107 |
| 4,268,738 | 5/1981 | Flautt, Jr. et al. | 219/10.55 F |
| 4,306,133 | 12/1981 | Levinson | 219/10.55 E |
| 4,316,070 | 2/1982 | Prosise et al. | 219/10.55 E |
| 4,330,696 | 5/1982 | Pomeroy | 219/10.55 F |
| 4,351,997 | 9/1982 | Mattisson et al. | 219/10.55 E |
| 4,390,554 | 6/1983 | Levinson | 426/232 |
| 4,398,077 | 8/1983 | Freedman et al. | 219/10.55 E |
| 4,416,907 | 11/1983 | Watkins | 426/234 |
| 4,518,651 | 5/1985 | Wolfe, Jr. | 428/308.8 |
| 4,626,641 | 12/1986 | Brown | 219/10.55 E |
| 4,656,325 | 4/1987 | Keefer | 219/10.55 E |
| 4,661,672 | 4/1987 | Nakanaga | 219/10.55 E |
| 4,703,148 | 10/1987 | Mikulski et al. | 219/10.55 E |
| 4,777,053 | 10/1988 | Tobelmann | 219/10.55 E |

*Primary Examiner*—A. D. Pellinen
*Assistant Examiner*—Leon K. Fuller
*Attorney, Agent, or Firm*—Arnold, White & Durkee

[57] ABSTRACT

A package for heating food in a microwave oven is disclosed. The package includes metal shielding or other metal components which cause a gain in electric field strength which is greater than 3. The present invention also involves low load microwave environments where the electric field strength is greater than 10 volts per centimeter. A rigid, dimensionally stable dielectric support is provided in close proximity to a conductive sheet, being spaced less than 0.5 inch from the conductive sheet. The dielectric support is composed of material selected to avoid failure of the dielectric support in high electrical fields which may exist near the conductive sheet during microwave irradiation. The dielectric support material has a dielectric loss factor less than 0.005, and a failure temperature greater than 101° C. The present invention relates to intrinsically nonarcing packages. A method for selecting packaging material for use in a shielded microwave container having a gain greater than 3 is also disclosed. A package material is selected having a combination of dielectric loss factor, heat capacity, density, and failure temperature, such that during microwave heating for a predetermined microwave heating time the failure temperature of the package material would not be exceeded.

39 Claims, 10 Drawing Sheets

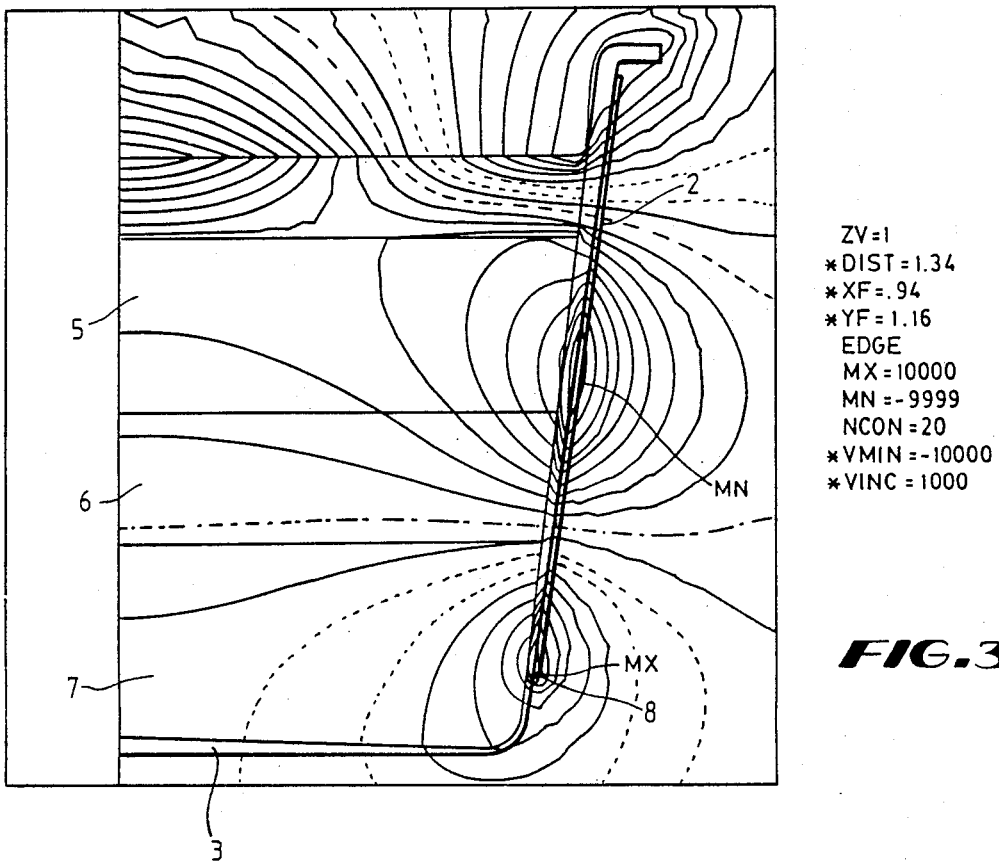
FIG.3
RESONANT GAIN IN FOIL STRIPS
FIG.4
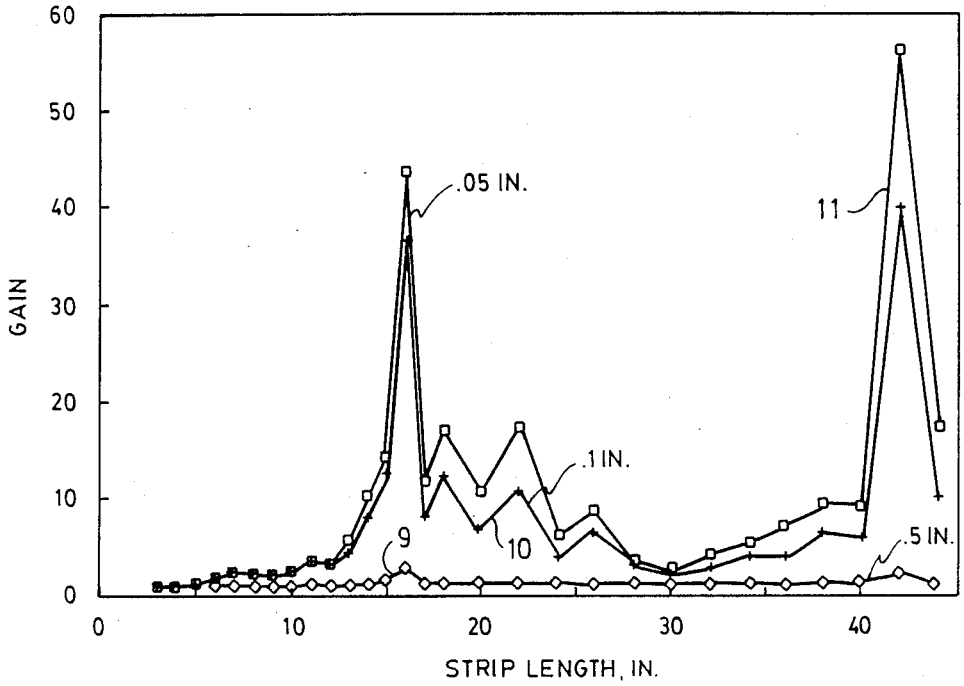

WAVEGUIDE CALIBRATION
OF E FIELD PROBE

PACKAGES MATERIALS FOR SHIELDED FOOD CONTAINERS USED IN MICROWAVE OVENS

CROSS-REFERENCE TO RELATED APPLICATIONS

This application discloses subject matter related to application Ser. No. 922,287, filed Oct. 23, 1986, by Dan J. Wendt, entitled "Food Container and Method of Manufacture", the entire disclosure of which is incorporated herein by reference. This application is also related to application Ser. No. 113,128, filed Oct. 23, 1987, by Ronald R. Lentz et al., entitled "Method and Apparatus for Measuring Strong Microwave Electric Field Strengths", which is incorporated herein by reference.

BACKGROUND OF THE INVENTION

In the past, the use of metal has been generally avoided in food packages intended for use in microwave ovens. Many attempts have been made to solve the problem of arcing. Recently, it has been discovered that metal shielding can be advantageously used in a food package intended to be heated in a microwave oven. For example, a shielded cylindrical shaped container may be used to produce desirable differential heating in food. A brownie may be heated in an unshielded portion of the package, while ice cream in a shielded zone of the package remains frozen. Metal foil is used to create a shielded zone in the package by wrapping the foil around the cylindrically shaped container.

So much attention has been directed to the problem of arcing that it has overshadowed other problems which have heretofore gone unrecognized. Even in a food package that does not arc when heated in a microwave oven, the addition of metal shielding to food packages has produced some unexpected packaging failures. Such failures include melting and discoloration of the packaging materials. It has been discovered that such failures tend to occur near the edges of the metal shielding.

In the past, packaging materials have been selected for use in a microwave oven based upon the heat stability of the packaging material. Typically, such packaging materials had a rate of heating in the microwave oven that was low relative to the food being heated in the microwave oven. The length of time for microwave heating, of course, is determined by the particular food substance involved. During this predetermined period of time for microwave heating, depending upon the food material that was being heated, typical packaging materials would have a rate of heating which was insufficient to cause adverse effects upon the packaging material itself. Materials selected for packaging should not melt, soften, deform or decompose due to the temperature of the heated food product. In the past, this was the primary concern for the selection of microwavable packaging materials.

However, the use of metal shielding in a package intended for heating in a microwave oven creates additional unexpected concerns. It has been discovered that the metal foil creates electrical fields, particularly concentrated around the edge of the metal foil, that intensifies the electrical field strength in the microwave oven. This intensification can be as great as 50 times the average field strength. In the intense fields which may occur when metal shielding is employed in a food package during microwave cooking, some packaging materials which normally have insignificant microwave absorption have been observed to melt or decompose in a matter of seconds.

The problem of melting packaging materials arises when foods are heated which present a low load to a microwave oven. When a meat roast is placed in a microwave oven, the oven will be so heavily loaded that the problems discussed above are unlikely to be observed. However, when low load foods such as small amounts of breadstuffs, frozen vegetables, or brownies are placed in a microwave oven, problems with packaging materials in close proximity to metal packaging components or shielding can be acute.

Therefore, the need has existed for the definition of packaging materials which are compatible with metal shielding in a microwave environment. Packaging materials must be selected which can be used in close proximity to metal shielding and which will remain stable during a reasonable heating time in a microwave oven.

SUMMARY OF THE INVENTION

The present invention relates to a package for heating of food material in a microwave environment employing a conductive sheet, typically metal foil, in close proximity to a dielectric material. The composition of the dielectric material is selected to reduce or minimize failure of the dielectric material during microwave heating. In one embodiment, the packaging system includes a conductive sheet or metal sheet that is formed around a portion of the food material containing zone of the package. The conductive sheet is typically employed as a shield to accomplish differential heating of the food substance. In other embodiments, a metal foil patch top lid may be used. In general, foil may be a desirable component in a food package to enhance graphics, for its barrier properties, or to actively modify the microwave field in a microwave oven. A dielectric support is selected for use in close proximity with the conductive sheet, or in contact therewith, which is composed of material selected to avoid failure of the dielectric support during microwave heating.

Dielectric support materials are selected to have a low dielectric loss factor, a high heat capacity, and a high density. The dielectric support material preferably has a dielectric loss factor less than 0.005. A dielectric loss factor less than or equal to 0.002 is more preferred. The dielectric support material preferably has a melting or decomposition temperature greater than 101° C. A melting temperature greater than or equal to about 149° C. is more preferred.

The present invention further includes the selection of a dielectric material for use with metal shielding or a conductive member, so that the material has a combination of features which results in a failure time that is greater than the microwave heating time determined by the food substance which is to be heated.

The advantages of the present invention are particularly applicable where metal shielding or other conductive members result in a gain in the electric field which occurs during microwave cooking. Gain typically occurs when the dimensions of metal shielding approach resonance. Gains in excess of 40, and even 50, have been observed. In microwave packages which include metal components, gain is sometimes difficult to avoid. In instances where gain cannot be avoided, it is necessary to select a suitable material for the other packaging components which can effectively perform in the presence of such gain due to metal components included in the package. In other applications, gain may be intentionally introduced. For example, metal components may be added to a microwave package in order to modify the electric fields. Where gain is intentionally introduced into a microwave package, non-metal package materials must be selected so that they can effectively survive the intensified electric fields which result. The present invention is particularly applicable where the gain is greater than or equal to about 3, and is especially applicable where the gain is greater than or equal to about 9.

BRIEF DESCRIPTION OF THE DRAWINGS

FIG. 3 is a computer generated graph illustrating the electrical field around a shielded container.

FIG. 4 is a graph depicting the gain in electrical field strength for various lengths of metal foil and at various distances from the metal foil.

DETAILED DESCRIPTION OF A PREFERRED EMBODIMENT

Figure 1:
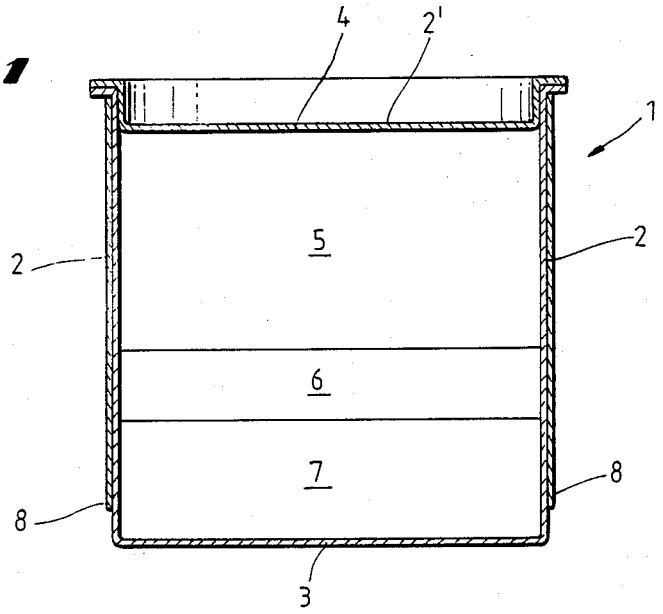
FIG. 1 is a cut-away side view of a package employing a metal shield.

FIG. 1 shows a cut-away view of a microwave food package 1 employing a metal shield 2 wrapped around a dielectric support, member or container 3. In the illustrated example, the package 1 includes a removable top 4 that is also covered by a metal shield 2'.

Figure 2:
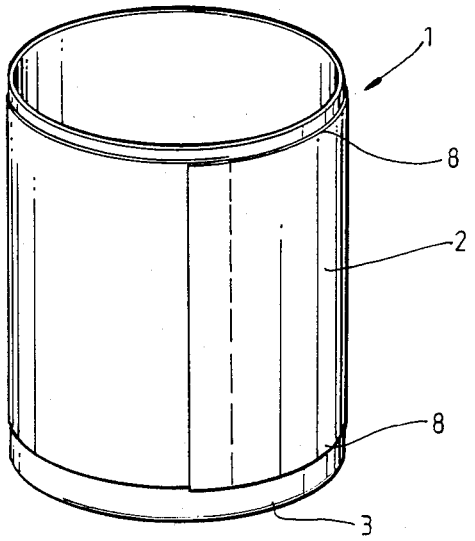
FIG. 2 is a perspective view of an empty cylindrical container having a shield.

FIG. 2 is a perspective view of the container 3 with the shield 2 wrapped around it in the form of a foil label 2.

In the particular example shown in FIG. 1, three layers of food substances are contained in the container 3. The food substances include an ice cream layer 5, a sauce layer 6, and a baked good layer 7. The baked good layer 7 may be a brownie layer 7. In this example, the metal shielding 2 and 2' forms a shielded zone in the container 3 which keeps the ice cream 5 freon while the baked good 7 is heated by microwave radiation.

The use of metal shielding 2, or a conductive sheet 2, around the container 3 has resulted in unexpected problems during microwave heating. It has been discovered that the metal foil 2 creates regenerated electrical fields, particularly concentrated around the edge 8 of the metal foil 2, that intensify the electrical field strength during microwave heating. This intensification can be as great as 50 times the average field strength where metal shielding is not used. In the intense fields which may occur when metal shielding 2 is employed around a food container 3 during microwave heating, some packaging materials used for the container 3 which normally have insignificant microwave absorption have been observed to melt or decompose in a matter of seconds.

FIG. 3 illustrates a computer generated graph of electrical field lines which may result during microwave heating. As shown in FIG. 3, the maximum electrical field strength tends to occur near the edge 8 of the shield 2.

When a dielectric support or container 3 is placed in close proximity to the metal shield 2, the effect of the increase in electrical field is most pronounced immediately next to the metal foil 2. This is shown by the graph of FIG. 4.

FIG. 4 represents the results of an experiment where strips of aluminum foil taped to paper were exposed to microwave energy. The heating rate of the paper was measured at the foil edge (i.e., 0.05 inch), 0.1 inch from the foil, and 0.5 inch from the foil. This was then compared to the heating rate of paper without any foil. Temperatures were measured with a Luxtron probe taped to the paper. The ratio of temperature with the metal strip versus temperature without the metal strip is expressed as "gain" in FIG. 4.

As the graph of FIG. 4 shows, the amount of gain is virtually negligible at distances greater than ½ inch from the edge of the metal foil 2. At distances where the dielectric material of the support 3 is within 0.05 inch of the edge of the metal foil 2, the gain in electrical field strength can be quite high, especially where the length of the metal shield 2 approaches resonance.

In FIG. 4, curve 9 represents the gain as a function of the length of a metal strip of foil at a distance of 0.5 inch from the edge of the foil. Curve 10 represents the gain at a distance of 0.1 inch from the edge of the metal foil strip. At this distance, the effect of gain upon a dielectric packaging material becomes appreciable, and the present invention is particularly applicable. Curve 11 represents the gain at a distance of 0.05 inch from the edge of the metal foil strip. Thus, it can be concluded that the metal shields 2 and 2' will have the greatest effect upon the dielectric material of the container 3 and top 4 that is less than about 0.5 inch from the metal shield 2 and 2'. The metal shields 2 and 2' have a greater effect upon the dielectric material of the support 3 and top 4 when the metal shields 2 and 2', respectively, have a resonant length. At resonance, the strength of the electric field around the edges 8 of the metal shield 2 increases dramatically.

Figure 5:
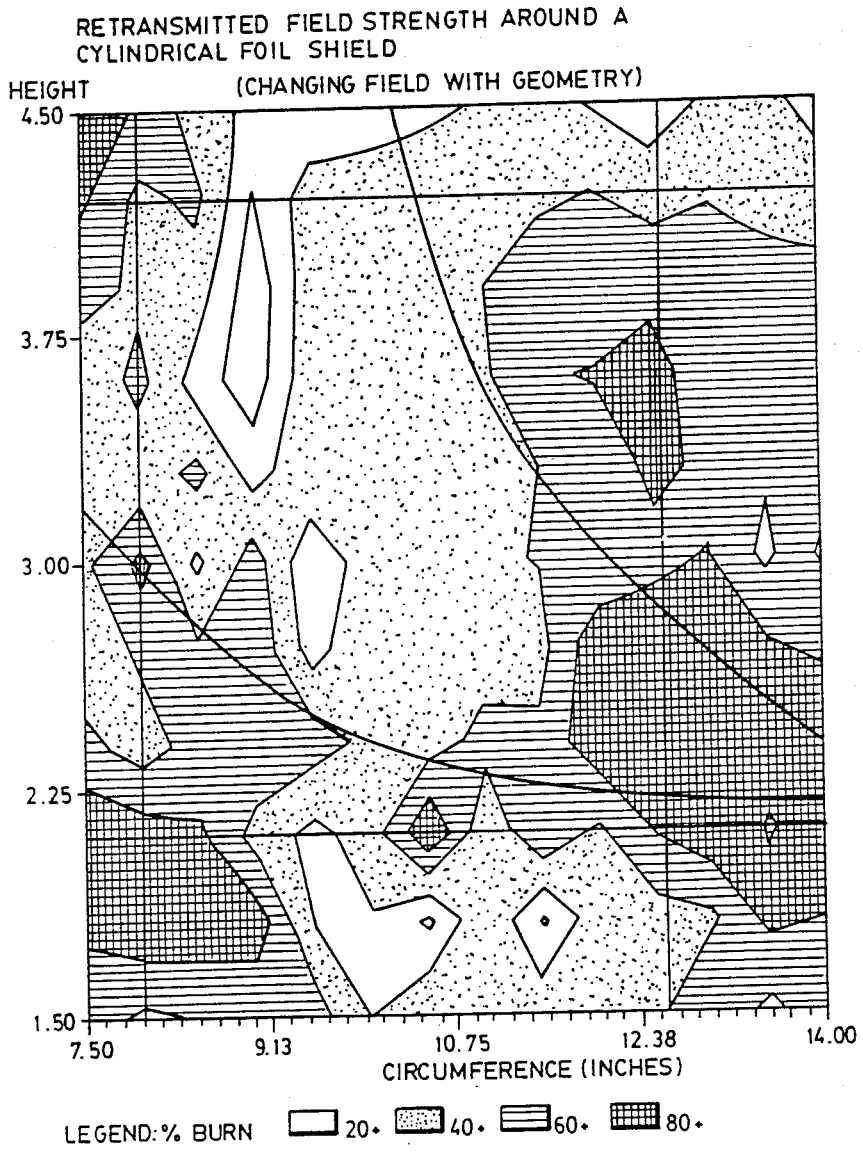
FIG. 5 is a graph illustrating field strength for a cylindrical shield as a function of the geometry of the shield.

FIG. 5 is a graph illustrating the results of experiments upon a variety of cylindrically shaped paper containers 3 having shields 2 wrapped around the containers 3. When the shielded containers 3 were exposed to microwave radiation, the retransmitted fields around the shield 2 caused heating in the dielectric papers. The cylinders 3 were tested for hot spots by coating the package with cellulose acetate. The particular cellulose acetate compound employed turned dark at 290° F. Thus, the cellulose acetate gave an indication of the extent to which the paper was being heated. The graph of FIG. 5 illustrates the amount of blackening that occurred over the aluminum foil shielded cylinder 3, as observed by the reaction of the acetate material to the heating of the paper. This experiment provides further information showing the effects of resonance and gain in electrical fields which may occur when metal shielding 2 is used in a package 1.

Therefore, in containers 3 employing metal foil shielding 2, it is necessary to select a dielectric material composition for the container 3 which has a combination of characteristics such that the container 3 can withstand the electrical fields which may exist around the edges 8 of the shield 2.

In a shielded container 3, such as is illustrated in FIG. 1, the intense electrical field at the base 8 of the metal foil label 2 caused paper to brown and char. Surprisingly, the intense electrical field also caused crystallized polyester terephthalate ("CPET"), which is normally considered to be a high heat stability plastic, to melt. Phenolic, a material that normally remains intact to 1000° F., decomposed in the presence of the metal foil 2 during microwave heating. When foil shielding 2 and 2' was not used on the container 3 during microwave heating, none of these materials had a significant heating rate compared to food.

The effect of electrical field strength in a microwave oven that is "loaded" with a food to be heated can be calculated from the rate of temperature rise of the food. The relevant relationship may be expressed as:

$$\frac{dT}{dt} = \frac{\omega\, Eo\, E''\mathrm{Erms}^2}{\rho\, C_p}$$

where $\omega$ is the angular frequency in radians per second, Eo is the dielectric constant of free space, E'' is the dielectric loss factor of the material that is being heated, Erms is the root mean square electrical field strength of the microwave energy heating the material, $C_p$ is the heat capacity of the material, and $\rho$ is the density of the material. In this case, dT represents the change in temperature, and dt represents the microwave heating time. The ratio of dT/dt is the rate of heating. The term "dielectric loss factor", represented by the symbol E'', will be understood by those skilled in the art to be expressed relative to the dielectric of free space.

Table I lists relevant properties of six materials which were evaluated for possible use as material for the container 3. E' represents the dielectric constant of the material. E'' represents the dielectric loss factor of the material. Of course, E'' should always be measured at the frequency of interest, i.e., the frequency of the microwave oven. $C_p$ is the heat capacity of the material, and $\rho$ is the density of the material. The melting temperature, or decomposition temperature, is also listed where applicable. The information for Table I was taken, in part, from *Plastics Materials & Processes*, by Seymour S. Schwartz and Sidney H. Goodman (1982), published by Van Nostrand Reinhold Co.

TABLE I

| MATERIAL TESTED | E' | E'' | $C_p$ cal/g °C. | $\rho$ g/cc | Melting °C. | Decomposition |
|---|---|---|---|---|---|---|
| H.D. Polyethylene | 2.2 | 0.0013 | 0.5 | 0.92 | 115 | |
| Polypropylene | 2.2 | 0.0011 | 0.5 | 0.9 | 176 | |
| CPET | 3.0 | 0.015 | 0.5 | 1.0 | 235 | |
| Polystyrene | 2.5 | 0.00083 | 0.32 | 1.07 | 100 | |
| Phenolic Resin | 3.5 | 0.148 | 0.4 | 1.1 | | 540° C. |
| Paper | 2.7 | 0.15 | 0.5 | 0.3 | | 200-250° C. |

In Table I, the density for polypropylene was rounded to 0.9 g/cc. The density actually used was 0.899 g/cc.

Although the melting temperature for CPET is relatively high, and the decomposition temperature for paper and phenolic resin are relatively high, it has surprisingly been found that polypropylene and high density polyethylene are especially preferred materials for the composition of the container 3, particularly in the area near the edge 8 of the shield 2, while phenolic resin, paper and CPET are unsuitable.

Using the properties of the packaging materials listed in Table I, the above equation was used to calculate the theoretical heating rate of these materials in a microwave oven. The electrical field strength Erms was first experimentally determined by measuring the heating rate of 200 grams of water in a 700 watt microwave. The equation was then solved for Erms, and the field strength calculated to be 12 volts per centimeter, plus or minus 1.4 volts per centimeter. At a given power input, the average electric field strength Erms will depend upon, and be a function of, the particular load which is placed in the oven. In a heavily loaded oven, the electric field strength would be lower. Using this value for Erms, Equation 1 was used to calculate the theoretical temperature rise for the packaging materials listed in Table I. The results of these calculations are set forth in Table II. None of the listed materials had a temperature rise that is close to the heating rate of water. Moreover, none of the materials would appear to come close to the failing temperature of the material. The terms "failing temperature" or "failure temperature" are used herein to refer to the melting temperature, if the material 3 is a material that melts, or the decomposition temperature, if the material 3 is a material that decomposes. "Failure temperature" also includes the temperature at which any undesirable change occurs in the package material 3, such as deformation, discoloration, charring, detrimental outgassing, or detrimental softening.

TABLE II

| PREDICTED TEMPERATURE RISE | Temperature Rise °C./sec |
|---|---|
| Water | 0.559 |
| H.D. Polyethylene | 0.00013 |
| Polypropylene | 0.00020 |
| CPET | 0.00139 |
| Polystyrene | 0.00013 |
| Phenolics | 0.0156 |
| Paper | 0.0467 |

Of course, the actual temperature rise may depend upon changes in dielectric loss which may occur during heating, and changes in Erms which may occur.

An experiment was performed in the same 700 watt microwave oven with samples of packaging materials placed two inches from the center of the oven. Two hundred milliliters of water were placed at the center of the oven to provide a "load" for the oven. Temperatures in the oven were measured with a Luxtron fluoroptic thermometry system, Model 750. Initial rates of temperature rise were calculated by linear regression for the first ten seconds of heating, where measurements were taken every second, in order to avoid cooling effects of conduction or convection. A Luxtron probe was taped to a small sample of the material being studied which was placed in the microwave oven with the water load. Heating rates were measured and electrical field strengths were calculated.

The electrical field strengths which were determined in this manner are listed in Table III. None of the heating rates observed would raise a concern of failure of the material during a typical heating period in a microwave oven.

TABLE III

OBSERVED HEATING RATES

| | Temperature Rise °C./sec | Erms V/M |
|---|---|---|
| Water | 0.572 | 1,200 |
| H.D. Polyethylene | 0.0878 | 30,992 |
| Polypropylene | 0.078 | 23,410 |
| CPET | 0.1245 | 11;327 |
| Phenolics | 0.38 | 5,909 |
| Paper | 1.069 | 5,748 |
| Wet Paper | 2.612 | 3,957 |

Figure 6:
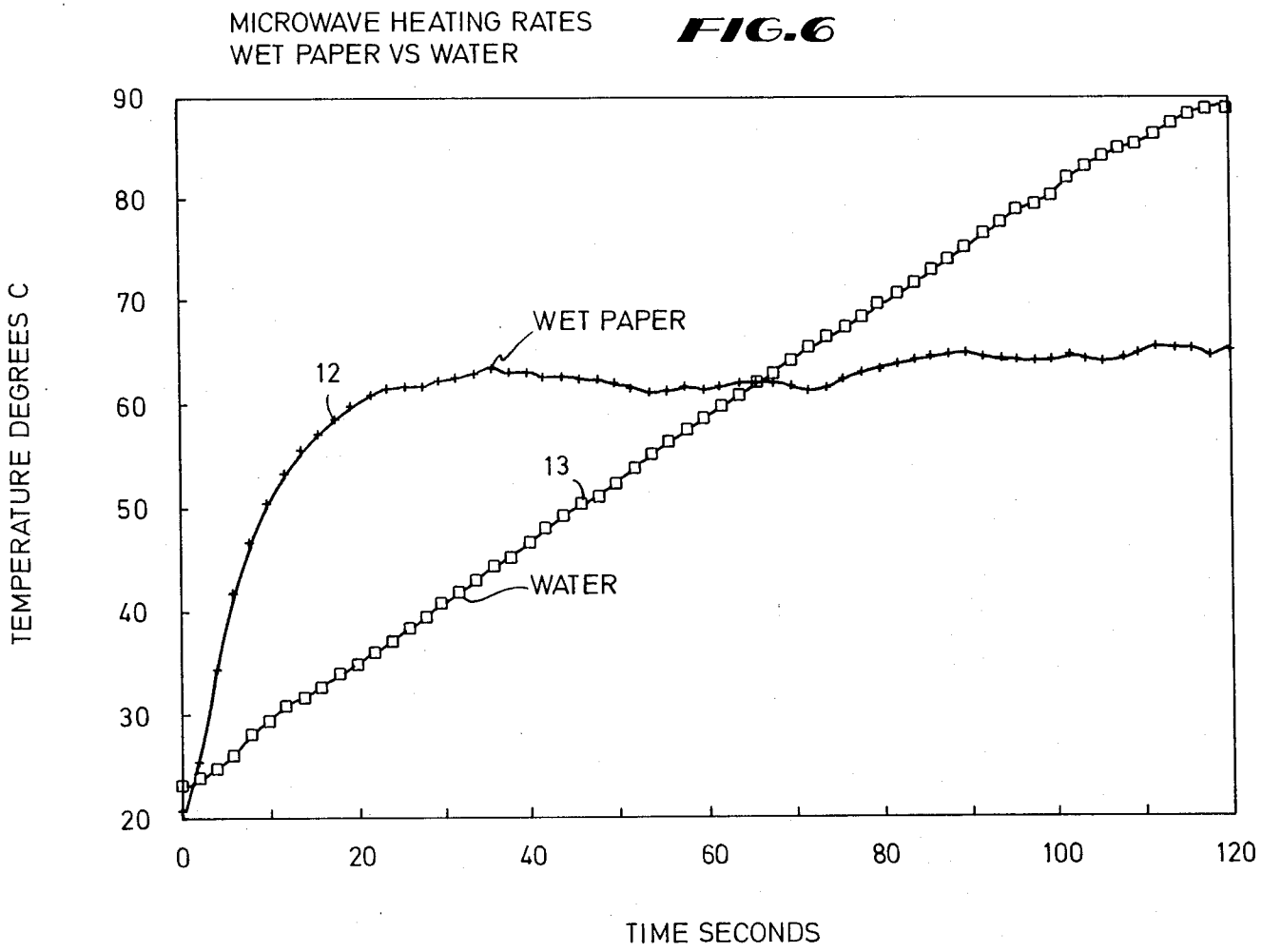
FIG. 6 is a graph depicting the heating effects of microwave radiation upon wet paper as compared with water.

Paper, although having a high initial heating rate, quickly started to dry out and lose its lossiness. This decreased the heating rate of paper. This effect is shown more fully in FIG. 6. FIG. 6 is a graph illustrating the heating rate of wet paper as compared with the heating rate of water. Although wet paper initially heats very rapidly, in the experiment represented in FIG. 6, the heating rate of the wet paper rapidly leveled off at about 60° C. This is shown by curve 12 in FIG. 6. Curve 13 represents the heating rate of water.

An experiment was then conducted where samples of packaging material were heated in a microwave oven with a strip of aluminum foil. A 1.5 inch long strip of foil was used. The length of the foil was slightly detuned from the length of a half wave resonant strip in order to decrease the gain slightly to facilitate measurement of initial temperature rise. The strip of foil was in contact with the sample of packaging material.

The results of this experiment are summarized in Table IV. As shown in Table IV, the heating rates were increased by 4 to 17 times the heating rate without the metal foil strip. The average gain was about 10.5. The "tuning" or "detuning" of the metal foil strip was believed to be effected by the proximity of the various materials of different dielectrics. The results of this experiment show that the heating rate of all these materials was observed to be faster than water, and faster than the heating rate of most foods. This startling result may explain why some packaging materials fail when used in combination with a metal shield 2.

TABLE IV

EFFECT OF RESONANCE IN FOIL

| | HEATING RATE °C./sec | Erms KV/m | GAIN $\left(\frac{\text{HR FOIL}}{\text{HR BULK}}\right)$ |
|---|---|---|---|
| H.D. Polyethylene | 0.695 | 87.2 | 7.91 |
| Polypropylene | 1.355 | 97.6 | 17.37 |
| CPET | 1.611 | 40.7 | 12.94 |
| Phenolics | 1.574 | 12.0 | 4.14 |
| Paper | 7.11 | 14.8 | 6.65 |
| Wet Paper | 38.3 | 15.1 | 14.66 |

In the experiments represented in Table IV, polystyrene was excluded from the test. A small arc caused samples of polystyrene to burn. Such burning of the polystyrene risked the loss of the Luxtron probes used in the experiment.

Based on these observed heating rates, the time to failure was calculated. The results of the predicted failure time based on such calculations, and the observed failure time during experimentation, are summarized in Table V. When used in conjunction with a metal foil shield 2, materials such as paper, phenolic, and CPET failed within 27 seconds or less. A microwave heating time of six minutes was determined based upon the food substance which was desired to be heated. High density polyethylene and polypropylene did not fail during the predetermined six minute microwave heating time. Heating was discontinued after six minutes.

Polystyrene also lasted longer than six minutes. Polystyrene, however, has a tendency to fail if an arc occurs. In one experiment, the occurrence of an arc resulted in a fire. In some applications, polystyrene may be an undesirable microwave packaging material for use in connection with a metal shield 2, because arcing can sometimes occur when a metal shield 2 is employed. Formulations for polystyrene may be developed which overcome such problems.

TABLE V

PACKAGING MATERIALS TIME TO FAILURE

| | FAILURE TEMP °C. | PREDICTED FAILURE TIME | OBSERVED FAILURE TIME |
|---|---|---|---|
| H.D. Polyethylene | 115 | 551 sec. | >6 min. |
| Polypropylene | 176 | 390 sec. | >6 min. |
| CPET | 235 | 146 sec. | 27 sec. |
| Phenolic | 540 | 20.5 sec. | 27 sec. |
| Paper | 500 | 1.1 sec | 18 sec. |
| Polystyrene | 100 | — | >6 min. |

The time to failure of the packaging materials listed in Table V generally follows the calculated results based upon experimental measurements. The actual time to failure was also believed to be a function of heat transfer rate. To some extent, the dielectric constant and/or dielectric loss factor of the material was believed to change with temperature in some cases.

It has thus been discovered that, surprisingly, high density polyethylene and polypropylene are especially preferred materials for a microwave shielded container 3. Other preferred materials include copolymers of polypropylene and polyethylene.

Copolymers of polypropylene and polyethylene are either a blend or copolymerization of polypropylene, polyethylene and EPR (an ethylene/propylene rubber formed during copolymerization). The final product used in packaging is generally 12–14% EPR, about 2% polyethylene and the balance polypropylene. The percentage of polyethylene may be varied. As more polyethylene is added to the blended composition, impact strength increases and temperature resistance decreases. Thus, the amount of polyethylene added to the composition involves a tradeoff between impact strength and temperature resistance. For example, about 20% polyethylene is used in copolymers from which automobile parts are fashioned where impact strength is an important consideration. EPR levels of up to 21% have been used in some applications, but such large percentages of EPR are not typically utilized in food applications. A suitable copolymer that has given good results in practice is made by Himont U.S.A., Inc., under the trademark PROFAX 7531, intermediate impact propylene copolymer for food packaging.

For purposes of the present invention, copolymers of polypropylene and polyethylene oftentimes perform with equivalent results as polypropylene alone, with the exception of melting temperature. The essential characteristics of specific gravity, heat capacity and dielectric loss factor are not significantly affected in most copolymer compositions.

High density polyethylene having a specific gravity of about 0.95 or greater and a melting temperature of about 115° C. or higher is believed to give satisfactory results. A high density polyethylene having a crystallinity of about 90% or greater may give good results. A high density polyethylene having a softening temperature of about 266° F. and a density of about 0.952 to about 0.958 g/cc has been used in practice with good results.

Isotactic polypropylene having a specific gravity of about 0.90 or greater, and a melting temperature of about 149° C. or higher, is believed to give satisfactory results in practice. A melting temperature greater than or equal to 165° C. is more preferred. An isotactic polypropylene having a density of about 0.899 g/cc and a heat deflection temperature of about 78° F. at 66 psi has given good results.

The dielectric support 3 should be preferably composed of a material having a heat capacity of about 0.5 calories per gram degrees centigrade, or greater. A dielectric support 3 having a density of about 0.89 grams per cubic centimeter, or greater, is preferred.

The metal shields or conductive sheets 2 and 2' preferably are composed of aluminum. The metal shields 2 and 2' could generally be any type of conductive sheets. Any metal may be used for the shields 2 and 2' if it is a good conductor. Suitable metals include gold, silver, steel, copper and tin.

The conductive sheets 2 and 2' preferably are in contact with the support 3. As used in this context, "contact" includes examples or embodiments where the conductive sheets 2 and 2' are adhesively bonded to the container 3, even though a thin layer of adhesive may actually be interposed between the conductive sheet 2 or 2' and the container 3.

The illustrated conductive sheets 2 and 2' are uncoated. In some applications, metal foil used in a microwave oven has been coated with insulating plastics in an effort to control arcing. Such coatings tend to reduce the electrical field strength Erms which impinges upon the packaging material. Such coating techniques are relatively expensive, and are unnecessary using the present invention.

Although high density polyethylene is preferred as a packaging material, in some applications medium density polyethylene or low density polyethylene will give satisfactory results. Linear low density polyethylene may give useful results in some applications. In general, polyethylene is considered to be a suitable packaging material for many applications. Table VI below lists the properties for polyethylene in terms of density, melting temperature, and percent crystallinity:

TABLE VI

| | $\rho$ g/cc | $T_m$ °C. | % Crystallinity |
|---|---|---|---|
| Polypropylene | .89–.92 | 149–180 | 50–70% |
| Linear low density polyethylene | .91–.93 | 120–130 | 35–45% |
| Low density polyethylene | .91–.927 | 105–115 | 40–65% |
| Medium density polyethylene | .928–.94 | 115–127 | 55–75% |

TABLE VI-continued

| | $\rho$ g/cc | $T_m$ °C. | % Crystallinity |
|---|---|---|---|
| High density polyethylene | .94–.97 | 127–138 | 65–90% |

In summary, packaging materials normally have an insignificant rate of heating in a microwave oven as compared to the heating rate of food. However, it has been discovered that the addition of metal foil shielding 2 to a microwave package 1 can intensify the electrical field at the edges 8 of the foil shield 2 by as much as 50 times the average field strength. In view of this gain in the electrical field strength, selecting a packaging material for heat stability is an insufficient basis for making a selection. A low microwave loss factor has been discovered to be a necessary requirement when a dielectric container 3 includes metal shielding 2.

Figure 10:
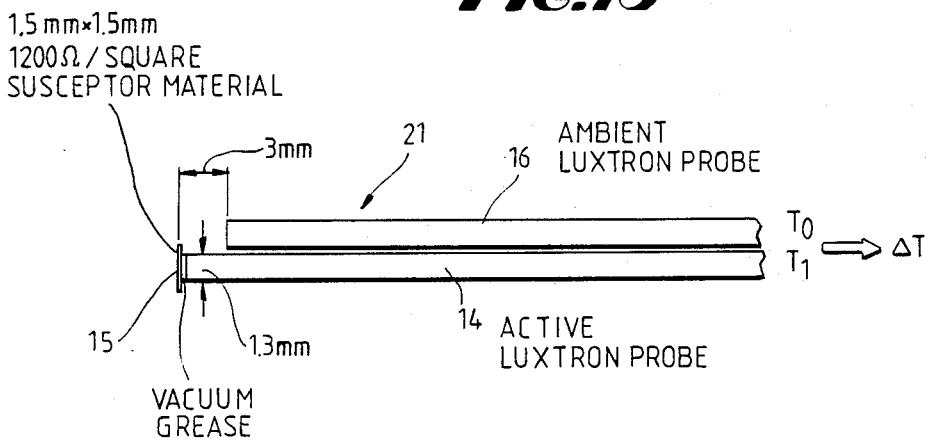
FIG. 10 is a side view of a probe used to measure electrical field strength.

The time to failure of packaging materials may be expressed as:

$$t_f = \frac{(T_f - T_i)\,\rho\, C_p}{\omega\, Eo\, E''(\text{Erms})^2}$$

where $t_f$ is the time to failure for the packaging material, measured in seconds. $T_f$ is the failure temperature in degrees centigrade for the packaging material. For most materials, this is the melting temperature. For some materials, it is the decomposition temperature. $T_i$ is the initial package temperature, expressed in degrees centigrade. $\rho$ is the density of the packaging material, expressed in kilograms per cubic meter. $C_p$ is the heat capacity of the packaging material, expressed in joules per kilogram degree centigrade. Eo is the dielectric constant of free space, which is equal to about $8.8\times10^{-12}$ farads per meter. $\omega$ is the angular frequency of electromagnetic radiation, which in the case of a typical microwave oven is $2\pi\times2.45\times10^{9}$ per second. E'' is the dielectric loss factor of the packaging material. Erms is the root means square electric field strength, expressed in volts per meter, which is applied to the packaging material. Erms is the local field intensity measured at, or as near as possible to the edge 8 of the shield 2. Erms can be measured using a probe, such as shown in FIG. 10 and described below.

Using the above relationship for time to failure, packaging materials may be evaluated to determine whether they will be suitable when subjected to the high Erms electric fields which may result when metal shielding is used in a microwave oven. The packaging material is selected so that the heating of the dielectric packaging material is such that the period of time necessary to properly heat the food substance which is to be heated is less than the time to failure. A suitable packaging material is selected which has a combination of density, heat capacity, and dielectric loss factor so that the time to failure will not be less than the necessary heating time for the food which is to be heated in a microwave oven.

By measuring the electrical gain of a shielded package 1, the microwave heating time before failure of the container 3 can be calculated. High density polyethylene and polypropylene have been discovered to be good materials for the dielectric container 3. These materials have both a high heat stability and a low dielectric loss factor. CPET, which has a higher heat stability, will actually reach its melting point faster because it has a higher dielectric loss factor. Even though paper has a very high decomposition temperature, paper will brown or even char at the edges 8 of the foil shield 2 because its loss factor is orders of magnitude higher than most other packaging materials.

It is particularly important in this invention to appreciate that a good packaging material is determined by a combination of material characteristics. One factor may be varied, and a second factor may also be simultaneously varied, so that the two factors equally offset each other. The net result would be two different packaging materials which were equivalent for purposes of this invention. For example, a good packaging material depends on a combination of density, heat capacity, and dielectric loss factor. The density could be reduced, and the loss factor could be simultaneously reduced by an equal factor or a proportionate amount, to result in an equivalent packaging material. Similarly, the heat capacity could be reduced, and the density could be increased by an amount so that the product of the two was the same, to yield equivalent results. What is important is the ratio of the dielectric loss factor divided by the product of the heat capacity times the density. Any combination of these three factors which yields an identical answer should produce equivalent results.

Of all of the above three factors, the dielectric loss factor is the most important factor. For most available packaging materials, the dielectric loss factors of the various materials may vary by orders of magnitude, whereas typical densities and heat capacities may not vary as widely.

Figure 7:
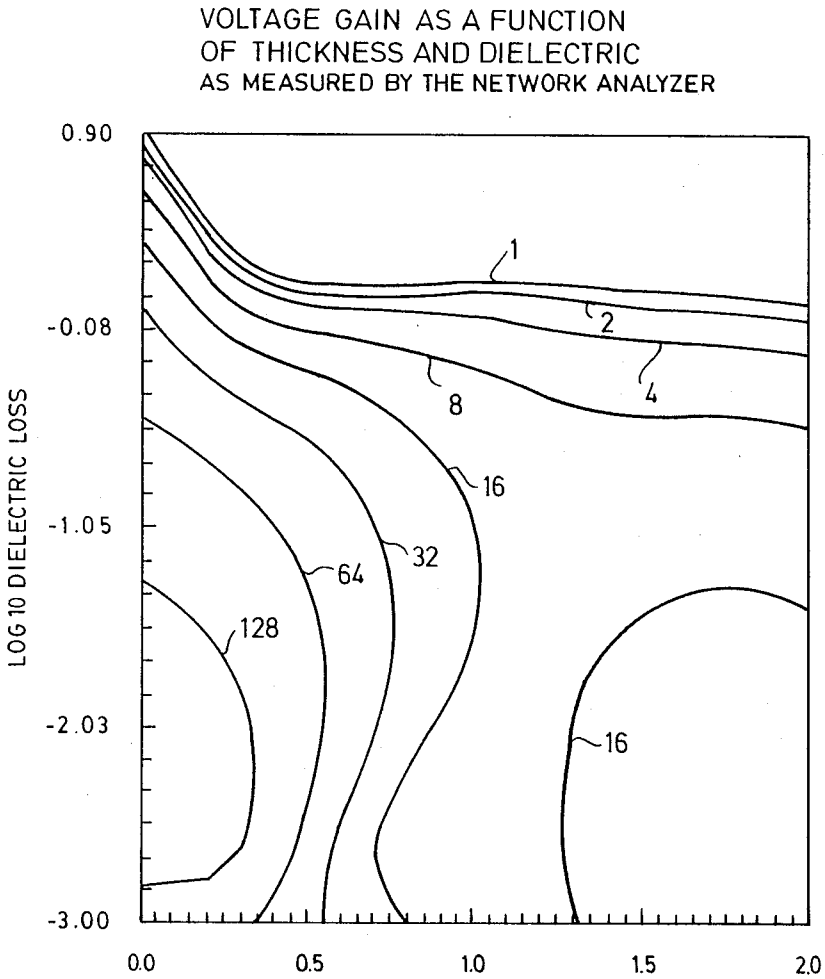
FIG. 7 is a graph depicting contour plots showing voltage gain as a function of thickness and dielectric properties.

FIG. 7 is a graph which shows a contour plot for voltage gain as a function of thickness and dielectric properties of the packaging material. These contour plots illustrate the effect of dielectric loss and material thickness on voltage gain. FIG. 7 shows that gain generally increases as dielectric loss factor decreases.

The curves plotted in FIG. 7 show that as dielectric loss increases, the thickness of the packaging material must generally decrease in order to achieve the same voltage gain. In the bottom area of the graph, a cyclical relationship between gain and thickness is apparent.

Figure 8:
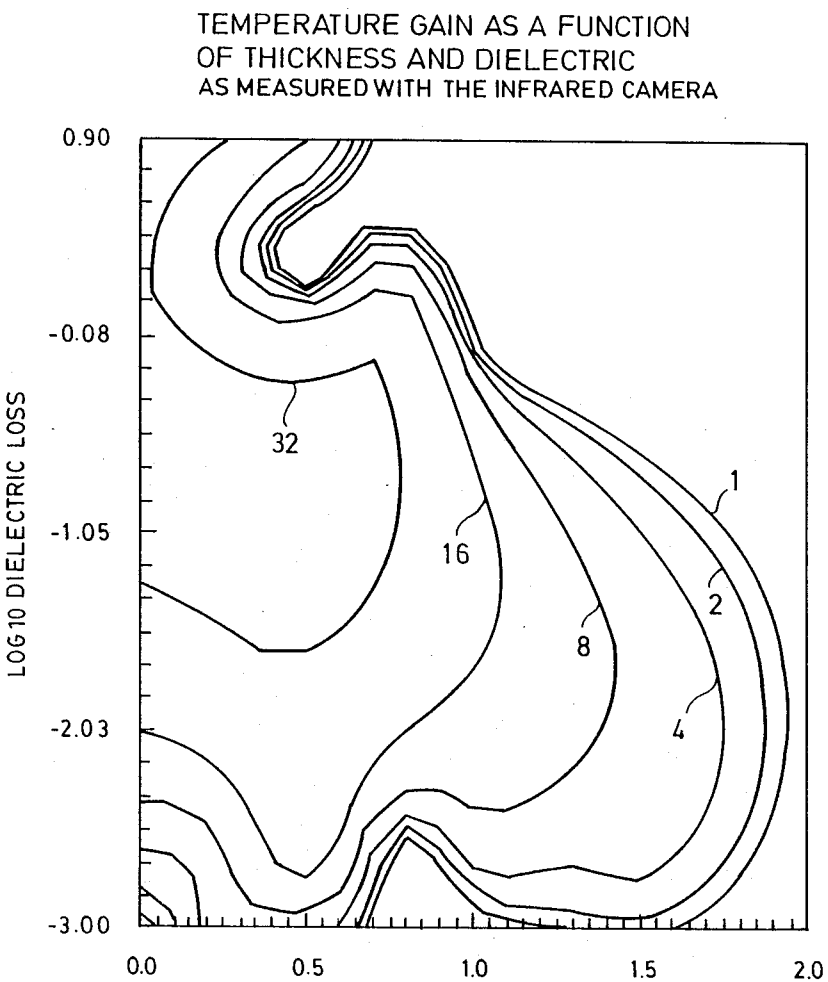
FIG. 8 is a graph depicting contour plots showing temperature gains as a function of thickness and dielectric properties.

FIG. 8 is a graph showing contour plots for temperature gain as a function of thickness and dielectric properties of the packaging material. The information graphed in FIG. 8 was measured with an infrared camera.

From FIG. 8 it may be seen that, at higher dielectric loss factors, thickness of the packaging material 3 makes more of a difference. At the lowest dielectric loss factor shown in FIG. 8, thickness makes less of a difference. The graph of FIG. 8 also shows that, at high loss factors, the rate of temperature rise is limited by the fact that the high dielectric loss tends to reduce the electrical field strength. In other words, the loading tends to "damp" the system. This may be better understood by considering FIG. 7 in conjunction with FIG. 8. At low values for the dielectric loss factor, the heating effects of the electrical field are not as significant because of the lower dielectric loss. In an intermediate range of dielectric loss factors, generally shown in FIG. 8 in the center region of the plotted dielectric loss factors, the dielectric loss is significant enough in relation to the strength of the electric field to result in significant heating. Thus, it can be concluded from a study of FIG. 8 that maximum heating effects tend to occur for packaging materials falling in the mid-range of plotted dielectric loss factors, which includes such materials as paper and CPET.

The rate of temperature rise may be expressed as follows:

$$\frac{\Delta T}{\Delta t} = \frac{\omega\, Eo\, E''\, \mathrm{Erms}^2}{C_p\, \rho}$$

As E'' increases, voltage gain, and therefore $\mathrm{Erms}^2$, decreases as shown in the curves plotted in FIG. 8. The two factors, E'' and $\mathrm{Erms}^2$, work against each other. A maximum occurs at some value for E'', for a given heat capacity and density.

A procedure or method has been developed for measuring a value for Erms to be used in the above calculations. The preferred procedure uses a Luxtron fluoroptic thermometry system. This system is preferred because it is a non-field-perturbing method of measurement in a microwave electrical field. Two probes are set up as shown in FIG. 10 to form a probe assembly 21.

In the illustrated example, an active Luxtron temperature probe 14 is constructed having a square piece of susceptor material 15 attached to the end thereof. The susceptor 15 is preferably made from a 1.5 mm × 1.5 mm square of susceptor material having a resistivity of about 1200 ohms per square. The susceptor 15 preferably comprises a sheet of metallized polyester. In the illustrated example, a thin film of stainless steel was sputtered on a sheet of 92 gauge polyester material. It is preferred that the sheet of metallized polyester not be bonded to a sheet of paper or other material, in order to minimize the effect upon thermal mass which such a sheet of paper or other material would have. The susceptor 15 is preferably attached to the probe 14 with vacuum grease, or other suitable adhesive.

A second ambient Luxtron temperature probe 16 is attached to the active Luxtron probe 14, or may be disposed in close proximity thereto. The second ambient probe 16 measures ambient air temperature near the active probe 14. In a preferred embodiment, the ambient Luxtron probe is spaced 3 millimeters from the end of the active Luxtron probe having the susceptor 15 attached thereto. The illustrated Luxtron probes 14 and 16 have a diameter of 1.3 millimeters.

First, the probe assembly 21 is calibrated. The calibration procedure preferably uses an adjustable microwave power source having a known or measurable power output. This may be used in conjunction with a wave guide having known characteristics. In the illustrated example, a Gerling Moore high power microwave source, sold under the trademark of "Genisys", is used in conjunction with a rectangular WR-284 wave guide.

Using the microwave power source, a known power input is placed into the wave guide. The electric field strength Erms can be calculated based upon the following formula:

$$P = \mathrm{Erms}^2 \frac{abk'}{2k\rho_0}$$

where P is the known power transmitted into the wave guide, expressed in watts; a is the width of the wave guide, in this example 0.0721 meters; b is the height of the wave guide, in this example 0.034 meters; $\lambda_0$ is the wavelength of the microwaves, in this example 0.124 meters; k is equal to $2\pi$ divided by $\lambda_0$; $\rho_0$ is the impedance of free space, in this example 376.7 ohms; Erms is the electrical field strength expressed in volts per meter;

k' is the wave number of the wave guide, in this example it is equal to:

$$k' = \sqrt{\left(\frac{2\pi}{\lambda_0}\right)^2 - \left(\frac{\pi}{a}\right)^2}$$

Using this particular wave guide for the calibration procedure, the above expression can be simplified as follows:

$$\text{Erms} = 762\sqrt{P}$$

where P is the power in watts transmitted into the wave guide by the microwave power source, and Erms is the electrical field strength expressed in volts per meter.

Figure 11:
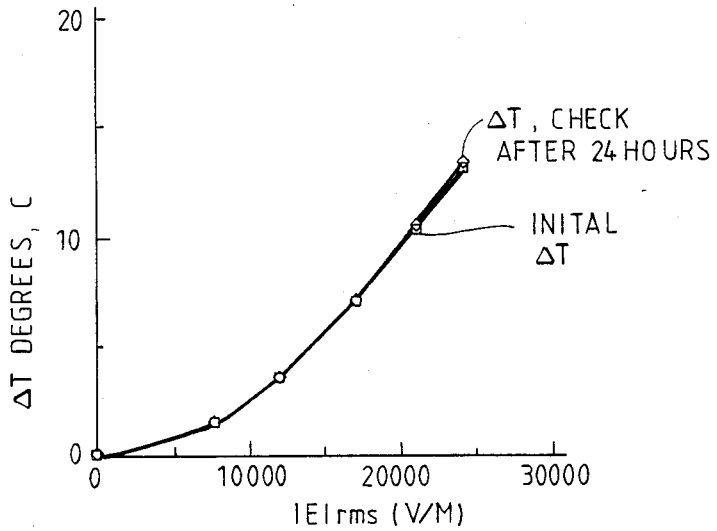
FIG. 11 is a graph depicting a calibration curve for the probe of FIG. 10.

The Luxtron probe assembly 21 illustrated in FIG. 10 is placed in the wave guide described above for calibration. A known microwave power level is then transmitted into the wave guide. The active Luxtron probe 14 is allowed to reach a steady state temperature. This usually occurs within seconds. Thus, a steady state temperature differential may be measured between the active Luxtron probe 14 and the ambient Luxtron probe 16. This temperature differential may be measured for several power settings. The temperature differential, expressed as ΔT, may be plotted versus Erms on a graph. Such a calibration plot of ΔT versus electric field strength Erms is shown in FIG. 11.

Once the Luxtron probe assembly 21 has been calibrated, the probe assembly 21 may be inserted into a microwave oven to measure the actual electrical field strength in the oven. The calibration curve shown in FIG. 11 is used to determine the electrical field strength Erms at the measured point. The composite Luxtron probe assembly 21 may be advantageously used to measure electrical field strength Erms adjacent a metal shield 2 on a microwave container 3.

The active Luxtron probe 14 shown in FIG. 10 is sensitive to electric fields in the plane of the susceptor 15. This particular probe has a minimal response to electric fields which are perpendicular to the plane of the susceptor 15. Thus, measurements may be affected by the orientation of the susceptor 15. Multiple measurements using different probe orientations may be taken to determine an average electrical field strength. In some cases, for example where a shield 2 is responsive to microwave energy having a particular polarization, the probe 14 may offer the advantage of measuring only the electrical field strength of interest.

In the illustrated example, Luxtron model MIC-02-10093 probes 14 and 16 were used. The probes 14 and 16 are connected to a Luxtron fluoroptic thermometry system, Model No. 750.

Using the time to failure calculation, set forth below, it is useful to examine several examples:

$$t_f = \frac{(T_f - T_i)\,\rho\, C_p}{\omega\, Eo\, E''(\text{Erms})^2}$$

In this example, the angular frequency w was equal to $2\pi \times 2.45 \times 10^9$ cycles per second. The dielectric of free space Eo was equal to $8.8 \times 10^{-12}$ farads per meter. In this example, a packaging material will fail if the time to failure $t_f$ is less than the product preparation time required in order to properly heat or cook the particular food product in a microwave oven.

A more preferred criteria for selecting a suitable package material is that the dielectric container 3 should not heat more than the food substance 5, 6 or 7 within the container 3. The temperature rise in the packaging material 3 may be measured using a Luxtron temperature probe. Alternatively, for purposes of this criteria, the temperature rise in the package material 3 may be calculated as follows:

$$\Delta T_p = \frac{\Delta t\, \omega\, Eo\, E_p''\, \text{Erms}^2}{\rho_p\, (C_p)_p}$$

where $\Delta T_p$ is the temperature rise in the package material or container 3; Δt is the heating time for the food product in seconds; Erms is the maximum local electrical field strength, typically at the edge 8 of the shield 2; $\rho_p$ is the density of the package material 3; $(C_p)_p$ is the heat capacity of the package material 3; and, $E_p''$ is the dielectric loss factor for the package material 3.

The temperature rise in each food substance 5, 6 or 7 may be measured using a Luxtron temperature probe.

The temperature rise in each food substance 5, 6 or 7 may also be separately calculated. In microwave food package systems which employ multiple food substances, the temperature rise in each food substance may be calculated using techniques disclosed in application Ser. No. 922,573, filed Oct. 23, 1986, by John R. Weimer, entitled "Food Product and Method of Manufacture", which is incorporated herein by reference. For purposes of the present invention, a simplified approach may be effectively utilized. For purposes of the present invention, the food substance which heats the most is of primary interest, and may be used for purposes of this criteria in selecting a suitable package material. Thus, only the temperature rise in the food substance 7 which is heated the most need be considered for purposes of this criteria. In many applications, only one food substance 7 will be desired to be heated.

For purposes of this criteria, the temperature rise of the food substance 7 may be calculated from the following equation:

$$\Delta T_F = \frac{\Delta t\, \omega\, Eo\, E_F''\, (\text{Erms}')^2}{\rho_F\, (C_p)_F}$$

where $\Delta T_F$ is the temperature rise of the food substance 7; Δt is the heating time for the food, expressed in seconds; $E_F''$ is the dielectric loss factor for the food substance 7; $\rho_F$ is the density of the food substance 7; $(C_p)_F$ is the heat capacity for the food substance 7; Erms' is the local electrical field strength within the food substance 7. The average electrical field strength is utilized in this calculation.

Thus, in order to meet the preferred criteria that the package material 3 does not heat more than the food substance 7, the temperature rise in both the package 3 material and the food substance 7 may be calculated. The temperature rise in the package $\Delta T_p$ should not be greater than the temperature rise $\Delta T_F$ in the food substance 7.

An additional criteria for selecting an even more preferred packaging material may be based upon selecting a package material 3 which does not exceed a maximum temperature of 60° C. during the heating time $\Delta t$ utilized to heat the food substance 7.

As an illustrative example, a one minute heating time is used as a typical time for heating a food substance ($\Delta t = 60$ seconds). The following values for a brownie food substance are utilized in the above equation: $\pi_F = 400$ kilograms per cubic meter; $(C_p)_F = 1256$ J/kg°C.; $E''_F = 0.5$. In this example, using a 700 watt microwave oven, an electrical field strength Erms of 3000 volts per meter is present. Substituting these values into the above equation, a temperature rise of about 72.7° C. results. Thus, starting from an ambient temperature of about 21° C., the brownie food substance 7 reaches a maximum temperature of about 93.7° C. during this one minute heating time.

In this example, a preferable container material 3 should be selected so that the package 3 does not have a temperature rise greater than the temperature rise of the food substance 7. Preferably, the package material should not rise more than 72.7° C. for a one minute heating time. (Of course, it is also necessary that the packaging material 3 not exceed its failure temperature during this time.)

The above-described principles may also be used, in connection with the relationships described below, to determine the maximum gain of the shield 2 which is permissible based upon the criteria used for selecting a suitable packaging material 3. That is, the maximum gain may be determined to avoid failure of the packaging material 3, or alternatively, the maximum gain may be determined for a preferred packaging material 3 which does not heat faster than the food product. As an illustrative example, the equation below may be used to calculate Erms for a package using CPET to determine maximum allowable gain which would comply with each of the three criteria discussed above:

$$\text{Erms} = \sqrt{\frac{\Delta T\, \rho_p\, (C_p)_p}{\omega\, Eo\, E_p''\, \Delta t}}$$

Using the equation for calculating the electrical field strength Erms, discussed above, the maximum field strength in order to satisfy the above three criteria may be calculated. First, the maximum field strength which may be reached to prevent failure of the packaging material 3 may be calculated. Second, the maximum field strength to ensure that the package material 3 remains cooler than the food substance 7 may be determined for a preferred packaging material. Finally, the maximum electrical field strength for an even more preferred packaging material 3 which does not exceed 60° C. may also be calculated.

Taking the example of cooking a brownie 7, a low load food item, using a package material 3 composed of CPET, the maximum Erms may be calculated as follows, where $\Delta T_p = \Delta T_F$:

$$\text{Erms} = \sqrt{\frac{\Delta T_p\, \rho_p\, (C_p)_p}{\Delta t\, \omega\, Eo\, E_p''}}$$

$$\text{Erms} = \sqrt{\frac{72.7 \times 1{,}000 \times 0.5 \times 4186}{60 \times 2\pi \times 2.45 \times 10^9 \times 8.8 \times 10^{-12} \times 0.015}}$$

$$\text{Erms} = 35{,}336 \text{ volts per meter}$$

In this example, the electrical field strength Erms may be measured for an identical package 1 which does not have a shield 2. If the measured Erms is 3000 volts per meter, then the gain may be calculated as follows:

$$\text{Gain} = 35{,}336 \div 3{,}000 = 11.8$$

Thus, for a food container 3 composed of CPET, the gain in electrical field strength at the edge 8 of the shield 2 cannot exceed 11.8 if the package material 3 is not to reach a temperature hotter than the brownie 7.

A less preferred condition, but a necessary condition, is that the package material 3 be selected so that the package material 3 does not reach a temperature sufficient to melt the package material 3. In the case of CPET, the melting point or failure temperature $T_f$ equals 235° C. Thus, the temperature rise for the package material 3 may be calculated as follows, assuming an initial temperature $T_i$ of 21° C.:

$$\Delta T_p = T_f - T_i$$

$$\Delta T_p = 235°\text{ C.} - 21°\text{ C.}$$

$$\Delta T_p = 214°\text{ C.}$$

Using the above value for $\Delta T_p = 214°$ C., the value of the electrical field Erms may be calculated. In this example, the Erms value which will cause melting of the CPET is 60,627 volts per meter. Thus, a container 3 composed of CPET will fail in this example if the gain is greater than 20.2.

In an even more preferred case, the package 3 should not exceed a temperature of 60° C. during the heating time $\Delta t$. In this example, utilizing a CPET container 3 and a brownie food substance 7, the temperature rise of the package $\Delta T_p = 60°\text{ C.} - \text{Ti} = 60°\text{ C.} - 21°\text{ C.} = 39°\text{ C.}$ Thus, the maximum electrical field strength Erms may be calculated. In this case, Erms equals 25,880 volts per meter. The gain in the electrical field strength due to the presence of the shield 2 may not be greater than 8.6 for this more preferred region of operation.

In this example, a comparison is made between polyethylene and the CPET container 3 used in the above example. Using the same gain which was calculated above, it is possible to calculate the temperature rise for a container 3 composed of polyethylene. In the case of polyethylene, for a gain equal to 11.8, the temperature rise $\Delta T$ equals 7° C. Thus, all other things being equal, a container 3 composed of polyethylene would only reach a temperature of about 28° C., assuming an initial temperature of 21° C. Similarly, for a gain equal to 20, the temperature rise $\Delta T$ equals 20.6° C. for polyethylene. In such an example, a container 3 composed of polyethylene would meet the most preferred condition, i.e., the container 3 would be cooler than 60° C.

Similarly, in the above example where the gain equals 11.8, for polypropylene $\Delta T$ equals 5.9° C. Where the gain equals 20, for polypropylene the temperature rise $\Delta T$ equals 17° C. Similarly, polypropylene would meet the most preferred condition, i.e., the package material 3 would remain cooler than 60° C.

Using the above analysis, one can also determine the gain required to make polyethylene fail. Using a melting or failure temperature of 115° C., the gain must equal 43.6 in order for polyethylene to fail. One can also calculate the maximum gain for a preferred package which does not become hotter than the food product. The maximum permissible gain for polyethylene to still attain this preferred condition is 38.4.

Another useful example of a container 3 composed of CPET may be considered for purposes of illustration. If we assume a microwave oven having a power rating of about 700 watts, with average field of about 30 volts per centimeter, we may calculate the electric field strength Erms, and the gain, which would cause the container 3 to melt. In this example, we assume the following food characteristics: 5 minute heating time $\Delta t$, specific gravity $\rho_F=1$, heat capacity $(C_p)_F=1.0$, and a dielectric loss $E_F''=1$. These food c istics would result in a final temperature for the food equal to 100° C., assuming an initial temperature of 21° C.

For CPET, the electric field strength Erms which would cause a failure of the CPET material, may be calculated where $\Delta T=235°\ C.-21°\ C.=214°\ C.$ Substituting in the appropriate one of the above-discussed equations, Erms may be calculated as follows:

$$\text{Erms} = \sqrt{\frac{214 \times 1.0 \times 1{,}000 \times 0.5 \times 4186}{300 \times 2\pi \times 2.45 \times 10^9 \times 8.8 \times 10^{-12} \times 0.015}}$$

$$\text{Erms} = 27{,}113$$

Where the average value of the electric field strength is 3000 volts per meter without the conductive shield 2, the gain in this example would equal 9.

Figure 9:
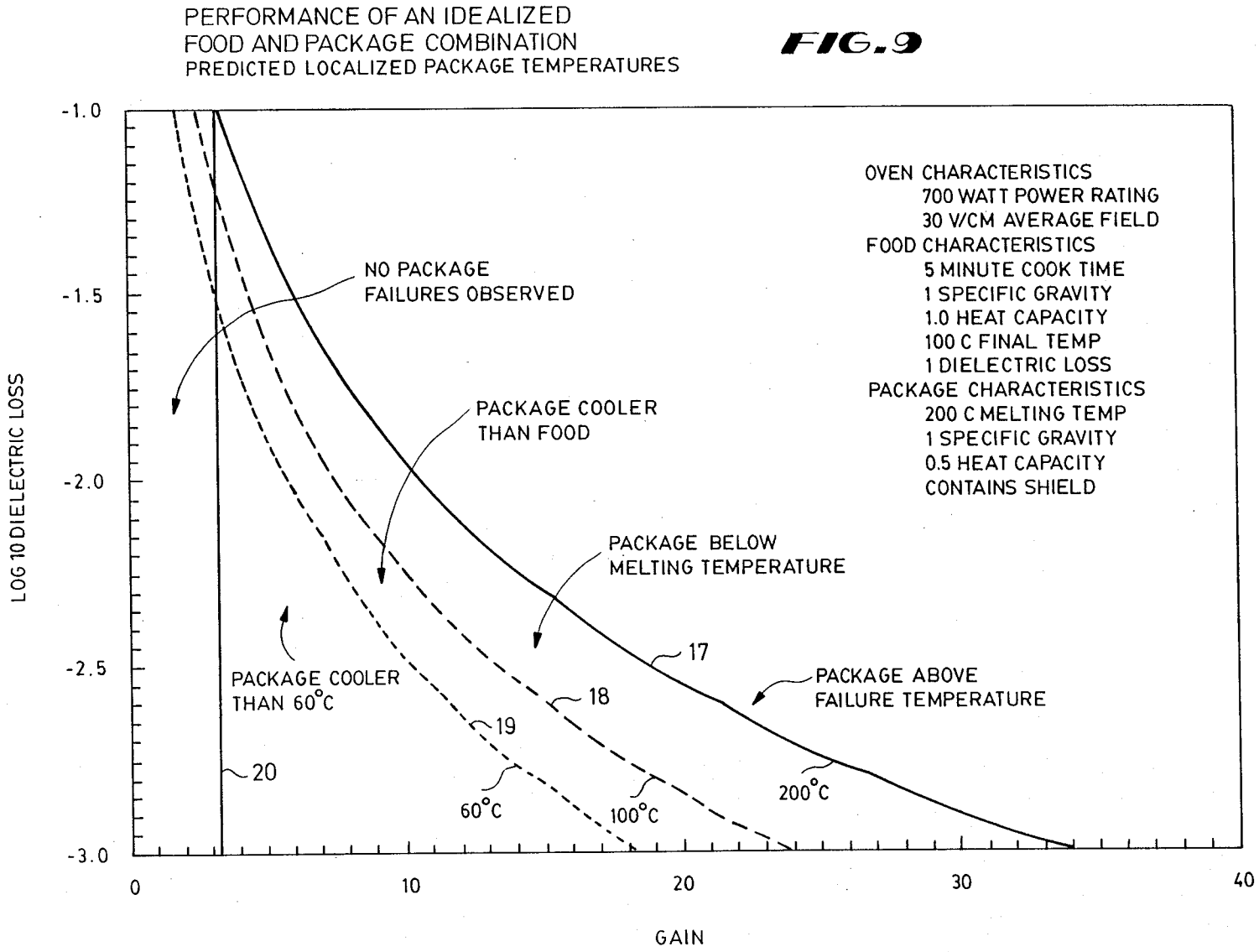
FIG. 9 is a graph depicting performance of an idealized food and package combination.

FIG. 9 is a graph depicting gain versus the dielectric loss factor for an example of a food and package combination. FIG. 9 used an example which employed typical ranges for heat capacity, specific gravity, and microwave heating time. The vertical axis shows $\log_{10}(E'')$.

The values taken from the above example may then be compared with the example plotted in the graph of FIG. 9. In the above example, E'' equals 0.015. In order to relate this value to the graph of FIG. 9, we must calculate the logarithmic value (base 10) for E''. In this case, $\log_{10}E''$ equals $-1.82$. A value for E'' of $-1.82$, results in a gain value equal to about 9. This agrees closely with the gain value plotted in FIG. 9 which corresponds to a dielectric loss factor $\log_{10}E''=-1.82$. The slight differences which may be observed result because FIG. 9 assumes a package material having a 200° C. melting temperature. The melting temperature for CPET is 235° C.

FIG. 9 illustrates the general relationship between dielectric loss factor E'' and gain. For any given example, the actual oven, food and package characteristics may be used to produce a graph which accurately reflects the characteristics for that particular example. For any given packaging material, however, a graph similar to that shown in FIG. 9 may be plotted to determine the acceptable gain for the three given criteria for selecting a packaging material for the container 3.

Thus, for any given example, a graph such as shown in FIG. 9 may be plotted where curve 17 represents the maximum gain for any given dielectric loss factor which would result in failure of the container 3. Curve 18 represents the maximum gain permissible, as a function of dielectric loss factor, to maintain the container 3 at a temperature less than the food 7. Curve 19 represents the maximum gain, as a function of dielectric loss factor E'', necessary to maintain the temperature of the container 3 less than 60° C.

Curve 20, and the regions to the left of curve 20 in FIG. 9, represents a region of operation where package failure is unlikely to occur regardless of the material selected for the container 3, due to the low gain. It has been discovered that the benefits of the present invention are not as significant in the region where the gain is less than about 3.

The present invention involves nonarcing packages or containers 3, 4 for heating food in a microwave oven. By "intrinsically nonarcing" it is meant that the package does not itself arc, e.g., result in arc discharges from one package component to another, or to the food, or to the floor of the oven. An "intrinsically nonarcing" package can sometimes be made to arc if placed too closely to adjacent food packages or metallic oven components other than the floor of the oven. Arcs which result in that manner are not considered for purposes of defining an "intrinsically nonarcing" package. In other words, an "intrinsically nonarcing" package can be made to arc if it is brought too closely to metallic oven components or to another package. The present invention arose as a result of the successful development of intrinsically nonarcing packages. It was only after such nonarcing packages had been developed that the problems solved by the present invention were recognized.

In some applications, instead of merely selecting a suitable packaging material 3 which meets one of the three criteria discussed above, it may be desirable to also adjust the gain of the microwave package 1. The gain resulting from metal components may be adjusted, for example, by changing the dimensions of the metal sheet 2. In some instances, the geometry of the metal components may be changed, such as by providing overlapping edges. Other techniques for adjusting the gain of the package are disclosed in application Ser. No. 922,287, filed Oct. 23, 1986.

In utilizing a conductive sheet or shield 2 to modify the heating of foods in a microwave oven, the tolerance and reproducibility of the heating effects upon the food are an important consideration. Tolerance and reproducibility of results depends significantly upon the dimensional stability of the container 3 and shield configuration. This may be broken down into two considerations: first the shield 2 must remain dimensionally stable during microwave heating in order to maintain a consistent modification of electric field, or else reproducibility of microwave heating effects on the food will be difficult; and, second the food containing cavity defined by the container 3, 4 must be dimensionally stable and essentially rigid. A variation in the configuration of the food containing cavity may affect the reproducibility and consistency of the heating effects upon the food from one package to another.

In the present invention, a rigid, dimensionally stable dielectric container 3 is preferred. The container 3 supports the conductive sheet 2, which is wrapped around the container 3. Thus, the dimensional stability of the conductive sheet 2 is also maintained by the rigidity of the container 3. These factors are important for consistent microwave performance where microwave packages are mass-produced for use in various consumer microwave ovens, whose characteristics may vary widely. By "dimensionally stable", it is meant that the dielectric support/conductive sheet configuration does not significantly change shape during microwave heating. Normally, the dielectric support/conductive sheet configuration should have the same shape from one package to another.

The present invention is particularly concerned with package materials 3 which are formed from organic compounds, i.e., compounds containing carbon atoms. Organic compounds are more likely to be affected adversely by undue levels of microwave heating when exposed to relatively high electric field strengths resulting from gain due to conductive elements in the microwave package 1.

The present invention is also particularly concerned with microwave environments of the type encountered in microwave ovens. The selection of suitable dielectric materials 3 for packages 1 which may only be exposed to extremely low field strength levels is not critical. The present invention is particularly applicable in microwave environments where the average electric field strength Erms is greater than 1 v/cm. In a typical application involving the present invention, the package 1 is designed to survive microwave radiation in the enclosed cavity of a microwave oven having a power input of at least 10 watts, more typically in excess of 400 watts.

In particular, the present invention is concerned with microwave packaging systems where the food material involved presents a low load to the microwave oven. At a given power input, the average electric field strength Erms will depend upon the particular load which is placed in the microwave oven. In a heavily loaded oven, the electric field strength will be lower. In a food package using a heavy load such as a meat roast, the oven will be so heavily loaded that the electric field strength Erms will be so low as to virtually eliminate the possibility of causing the packaging material to exceed its failure temperature. Thus, the present invention is applicable for food materials which present a low load to the microwave oven, because in such instances, the electric field strength Erms can reach sufficiently high levels to cause the packaging material to fail if it is not properly selected in accordance with the present invention.

As used herein, the term "low load" means that the average electric field strength in the immediate vicinity of the package or food can reach 10 volts per centimeter or greater. This condition may be shown to be satisfied by using two measurement techniques.

First, a Luxtron probe assembly 21 as illustrated in FIG. 10 may be used to measure the electric field strength in the immediate vicinity of the package 1. In making such a measurement, it is important to measure the average electric field strength around the package by taking measurements at several locations spaced approximately ½ inch to 1 inch from the surface of the package 1. In some instances, reflections from metal components 2 in the package 1 may produce spurious readings.

Second, the temperature rise $\Delta T$ in the food may be measured using a Luxtron temperature probe. The density $\rho$, heat capacity $C_p$ and dielectric loss factor E″ for the food may also be measured. Of course, the microwave heating time $\Delta t$ is also known, as well as the angular frequency $\omega$ of the microwave radiation and the dielectric constant of free space Eo. These values may be substituted into the equation for calculating Erms as follows:

$$\text{Erms} = \sqrt{\frac{\Delta T\, \rho\, (C_p)}{\Delta t\, \omega\, Eo\, E''}}$$

Low loads result in an electric field strength Erms of 10 volts per centimeter or greater. It is such high field strengths which cause problems with the failure of packaging materials.

A low load food product may result from two different factors. First, the food may be a low loss food, i.e., the dielectric loss factor E″ for the food may be a relatively low value. Second, even relatively glossy foods may constitute a low load where only small amounts of the food are present in the microwave oven. For example, quantities of food less than 200 grams may present a low load in a microwave oven even if the food has a relatively high dielectric loss factor E″.

In applications where food is cooked in the package 1, the temperature of the food will typically be elevated to 100° C. or greater. In applications where the food is reheated, the temperature of the food will typically be elevated to 60° C. or greater. Other applications may include thawing frozen food. Although some thawing applications may not involve a significant elevation of the food temperature, the package 1 is exposed to a significant level of microwave radiation for purposes of thawing the food, which does involve an appreciable amount of energy transfer as latent heat in order to change the state of water molecules in the food. Other applications may involve warming frozen food to room temperature, which typically involves a change of food temperature from about 0° C. or less to about 21° C.

The present invention is particularly applicable where conductive members 2 in a package 1 result in a gain. For purposes of the present invention, susceptor material is not considered to be "conductive." It is believed that gain within the meaning of the present invention does not result for susceptor members or sheets having a resistivity greater than 10 ohms per square. For purposes of the present invention, a conductive sheet member or element 2 means a conductive material which has a resistivity of less than 1 ohm per square, more preferably less than 0.1 ohm per square. For purposes of the present invention, a conductive material is a material in which a relatively large current flows when a potential is applied between two points on or in a body constructed from the material. Metal foil is considered to be conductive material for purposes of this invention. Typical metal foil thicknesses range between 0.000275 inch and 0.006 inch.

Other applications which contain additional disclosure and which are all incorporated herein by reference are application Ser. No. 903,007, filed Sept. 3, 1986, by William Atwell et al., entitled "Microwave Food Product and Method" and application Ser. No. 085,125, filed Aug. 13, 1987, by Peter S. Pescheck et al., entitled "Microwave Food Product and Method."

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of the teachings herein. The full scope of the invention shall be determined by a proper interpretation of the claims, and shall not be unnecessarily limited to the specific embodiments described above.

What is claimed is:

1. A package for heating of food material representing a low load in a microwave environment employing a conductive sheet in close proximity to a dielectric material that is selected to minimize failure of the dielectric material during microwave heating, comprising:

a conductive sheet, the conductive sheet being exposed to microwave radiation when the package is placed in a microwave oven and the oven is energized, the conductive sheet having an edge, the conductive sheet causing a gain in electrical field strength greater than 3 near at least a portion of an edge;

a rigid, dimensionally stable dielectric support for the conductive sheet, the dielectric support being mechanically associated with the conductive sheet to maintain dimensional stability of the combination of the dielectric support and the conductive sheet, the dielectric support extending beyond at least a portion of an edge of the conductive sheet, the dielectric support being spaced less than 0.5 inch from the conductive sheet, the dielectric support being composed of material selected to avoid failure of the dielectric support in high electrical fields which may exist near the conductive sheet during microwave irradiation, the dielectric support material having a dielectric loss factor less than 0.005, the dielectric support material having a failure temperature greater than 101° C.;

the package being an intrinsically nonarcing package;

food supported by the package, the food representing a low load in a microwave oven cavity, where microwave cooking is continued for a predetermined period of time desired according to the food selected for the package when the package is placed in a microwave oven cavity.

2. The package according to claim 1, wherein:
the dielectric support consists of high density polyethylene.

3. The package according to claim 2, wherein:
the dielectric support is in contact with the conductive sheet.

4. The package according to claim 3, wherein:
the conductive sheet consists of aluminum.

5. The package according to claim 1, wherein:
the dielectric support consists of polypropylene.

6. The package according to claim 5, wherein:
the dielectric support is in contact with the conductive sheet.

7. The package according to claim 6, wherein:
the conductive sheet is aluminum.

8. The package according to claim 1, wherein:
the dielectric support consists of high density polyethylene having a specific gravity of about 0.95 or greater and a melting temperature of about 115° C. or higher.

9. The package according to claim 8, wherein:
the dielectric support is spaced less than about 0.1 inch from the conductive sheet.

10. The package according to claim 8, wherein:
the dielectric support is in contact with the conductive sheet, and the conductive sheet is aluminum.

11. The package according to claim 1, wherein:
the dielectric support consists of isotactic polypropylene having a specific gravity of about 0.90 or greater, and a melting temperature of about 165° C. or higher.

12. The package according to claim 11, wherein:
the dielectric support is spaced less than about 0.1 inch from the conductive sheet.

13. The package according to claim 11, wherein:
the dielectric support is in contact with the conductive sheet, and the conductive sheet is aluminum.

14. The package according to claim 1, wherein:
the dielectric support has a heat capacity of about 0.5 calories per gram degree centigrade, or greater.

15. The package according to claim 14, wherein:
the dielectric support has a density of about 0.5 grams per cubic centimeter, or greater.

16. The package according to claim 15, wherein:
the dielectric support is in contact with the conductive sheet, and the conductive sheet is aluminum.

17. The package according to claim 1 wherein:
the dielectric support includes high density polyethylene.

18. The package according to claim 1 wherein:
the dielectric support includes polypropylene.

19. The package according to claim 18, wherein:
the conductive sheet includes aluminum.

20. The package according to claim 1, wherein:
the dielectric support consists of copolymers of polypropylene and polyethylene.

21. A package for heating of food material in a microwave oven employing a conductive sheet in close proximity to a dielectric material that is selected to minimize failure of the dielectric material during microwave heating, comprising:

a conductive sheet, the conductive sheet being formed around at least a portion of a food material containing zone, the conductive sheet being exposed to microwave radiation when food in the food material containing zone is heated by microwave radiation for a predetermined period of time, where the conductive sheet results in a gain in the electrical field strength Erms greater than 3; and, a dielectric support for the conductive sheet, the dielectric support being in close proximity to the conductive sheet and spaced less than 0.5 inch from the conductive sheet, the dielectric support being selected so that the heating of the dielectric support is such that the predetermined period of time for microwave cooking multiplied times the rate of temperature rise, plus the starting temperature, is less than the failure temperature of the dielectric support, the rate of temperature rise being determined by the dielectric loss factor divided by the product of the density times the heat capacity, all multiplied by a factor determined by the frequency of the microwave radiation, the dielectric constant of free space Eo, and the Erms value of the electric field, the dielectric support having a combination of dielectric loss factor E″, heat capacity $C_p$, and density $\rho$ selected to minimize failure of the dielectric support during microwave heating.

22. The package according to claim 21, wherein:
the dielectric support is made of a material selected from the group of polypropylene and polyethylene.

23. The package according to claim 21, wherein:
the dielectric support is made of polypropylene having a dielectric loss constant less than about 0.002.

24. The package according to claim 23, wherein:
the dielectric support has a melting temperature greater than or equal to about 149° C.

25. The package according to claim 24, wherein:
the dielectric support has a density greater than or equal to about 0.89 grams per cubic centimeter.

26. The package according to claim 25, wherein:
the dielectric support has a heat capacity greater than or equal to about 0.5 calories per gram degree centigrade.

27. The package according to claim 23, wherein:

the dielectric support has a melting temperature greater than or equal to about 170° C.

28. The package according to claim 21, wherein:

the dielectric support is made of polyethylene having a dielectric loss constant less than about 0.002.

29. The package according to claim 28, wherein:

the dielectric support has a density greater than or equal to about 0.89 grams per cubic centimeter.

30. The package according to claim 29, wherein:

the dielectric support has a heat capacity greater than or equal to about 0.5 calories per gram degree centigrade.

31. The package according to claim 28, wherein:

the dielectric support has a melting temperature greater than or equal to about 105° C.

32. A method for selecting packaging material for use in a shielded microwave container having a gain greater than 3, comprising the steps of:

determining the gain of a shield to be used in a microwave food package;

selecting a package material having a dielectric loss factor E″ less than 0.1;

further selecting a package material having a combination of dielectric loss factor E″, heat capacity $C_p$, density $\rho$ and failure temperature $T_f$, such that during microwave heating for a predetermined microwave heating time $\Delta t$ dependent upon the food substance to be heated in the food package:

$$\Delta t < \frac{(T_f - T_i)\,\rho\, C_p}{\omega\, Eo\, E''\,(\mathrm{Erms})^2}$$

where $T_i$ is the initial temperature of the package material, $\omega$ is the angular frequency of the microwave oven, Eo is the dielectric constant of free space, and Erms is the maximum electric field strength to which the package material is subjected during microwave heating; and, constructing a microwave food package having a gain greater than 3 and where the shield is spaced from the selected package material less than 0.1 inch.

33. The method according to claim 32, wherein the selecting steps further comprise the step of:

selecting a package material having a combination of dielectric loss factor E″, heat capacity $C_p$, and density $\rho$, such that during microwave heating for the predetermined microwave heating time $\Delta t$:

$$\Delta t < \frac{(T_F - T_i)\,\rho\, C_p}{\omega\, Eo\, E''\,(\mathrm{Erms})^2}$$

where $T_F$ is the final average temperature reached by the food substance desired to be heated at the end of the microwave heating time $\Delta t$.

34. The method according to claim 32, wherein the selecting steps further comprise the step of:

selecting a package material having a combination of dielectric loss factor E″, heat capacity $C_p$, and density $\rho$, such that during microwave heating for the predetermined microwave heating time $\Delta t$:

$$\Delta t < \frac{(60^\circ\,\mathrm{C.} - T_i)\,\rho\, C_p}{\omega\, Eo\, E''\,(\mathrm{Erms})^2}.$$

35. The method according to claim 32, wherein the step of determining the gain comprises the steps of:

measuring the average electric field strength Erms in the proximity of the package material of the microwave food package without the shield;

measuring the maximum electric field strength Erms in the proximity of the shield for the microwave food package with the shield; and, $$\text{calculating the gain} = \frac{\mathrm{Erms}}{E'\mathrm{rms}}.$$

36. The method according to claim 32, wherein the selecting step further comprise the step of:

selecting a package material having a dielectric loss factor E″ less than 0.01.

37. The method according to claim 36, wherein the constructing step comprises the step of:

constructing a microwave food package having a gain greater than 9.

38. A method of making a package containing a food product during heating in a microwave oven, said method comprising:

determining the gain of a conductive member adjacent a food product in a microwave field;

selecting a dielectric packaging material that has a dielectric loss factor sufficiently low such that said material will not detrimentally heat when said food product, said material and said conductive member are exposed to microwave radiation for heating said food product; and, making a package including said conductive member and a package portion made of said packaging material.

39. A package for heating of food material in a microwave environment employing a conductive sheet in close proximity to a dielectric material that is selected to minimize failure of the dielectric material during microwave heating, comprising:

a conductive sheet, the conductive sheet being formed around at least a portion of a food material containing zone, the conductive sheet being exposed to microwave radiation when food in the food material containing zone is heated by microwave radiation, the conductive sheet having an edge, the conductive sheet having a gain in electrical field strength greater than 3; and, a dielectric support for the conductive sheet, the dielectric support being in close proximity with the conductive sheet, the dielectric support being spaced less than 0.5 inch from the conductive sheet, the dielectric support extending beyond at least a portion of an edge of the conductive sheet, the dielectric support being composed of material selected to avoid failure of the dielectric support in high electrical fields which may exist near the conductive sheet during microwave irradiation, the dielectric support material having a dielectric loss factor less than 0.005, the dielectric support material having a melting/decomposition temperature greater than 101° C., where such microwave cooking is continued for a predetermined period of time desired according to the food material selected for the food material containing zone.

* * * * *

UNITED STATES PATENT AND TRADEMARK OFFICE

CERTIFICATE OF CORRECTION

PATENT NO. : 4,894,503

DATED : January 16, 1990

INVENTOR(S) : Dan J. Wendt

It is certified that error appears in the above—identified patent and that said Letters Patent is hereby corrected as shown below:

On the title page and in column 1, lines 2 and 3:

In the title, change "PACKAGES", to -- PACKAGING --.

Column 3, line 57, change "freon" to -- frozen --.

Column 13, line 64, change "w" to -- $\omega$ --.

Column 15, line 7, change "$\pi_F$" to -- $\rho_F$ --.

Column 17, line 10, change "c istics" to -- characteristics --.

Column 20, line 4, change "glossy" to -- lossy --.

Column 24, line 18 (line 2 of claim 36), change "step" (first occurrence) to -- steps --.

Signed and Sealed this

Eleventh Day of December, 1990

*Attest:*

HARRY F. MANBECK, JR.

*Attesting Officer*

*Commissioner of Patents and Trademarks*